US011628325B2

(12) United States Patent
Pinkart et al.

(10) Patent No.: US 11,628,325 B2
(45) Date of Patent: Apr. 18, 2023

(54) RESISTANCE ADJUSTABLE EXERCISE DEVICE

(71) Applicants: Patrick Pinkart, Los Osos, CA (US); Kelly Ferguson, Los Osos, CA (US)

(72) Inventors: Patrick Pinkart, Los Osos, CA (US); Kelly Ferguson, Los Osos, CA (US)

( * ) Notice: Subject to any disclaimer, the term of this patent is extended or adjusted under 35 U.S.C. 154(b) by 90 days.

(21) Appl. No.: 17/163,658

(22) Filed: Feb. 1, 2021

(65) Prior Publication Data

US 2022/0241637 A1 Aug. 4, 2022

(51) Int. Cl.

| | |
|---|---|
| ***A63B 21/00*** | (2006.01) |
| ***A63B 23/12*** | (2006.01) |
| ***A63B 21/015*** | (2006.01) |
| ***A63B 23/035*** | (2006.01) |

(52) U.S. Cl.

CPC ..... *A63B 21/00069* (2013.01); *A63B 21/015* (2013.01); *A63B 21/151* (2013.01); *A63B 21/4035* (2015.10); *A63B 23/03533* (2013.01); *A63B 23/1209* (2013.01)

(58) Field of Classification Search

CPC ..... A63B 21/015; A63B 21/151–152; A63B 21/4035; A63B 23/1209

See application file for complete search history.

(56) References Cited

U.S. PATENT DOCUMENTS 6,066,077 A * 5/2000 Horst ..... A63B 21/153 482/114
2021/0213322 A1* 7/2021 Smith ..... A63B 21/4049

* cited by examiner

*Primary Examiner* — Jennifer Robertson

(74) *Attorney, Agent, or Firm* — The Iwashko Law Firm, PLLC; Lev Ivan Gabriel Iwashko

(57) ABSTRACT

A resistance adjustable exercise device, including a resistance assembly to provide resistance to movement, a handle assembly connected to at least a portion of the resistance assembly to move the resistance assembly in at least one of a first rotational direction and a second rotational direction, and a control unit disposed on at least a portion of the handle assembly to adjust at least one of a first resistance level and a second resistance level of the resistance assembly.

17 Claims, 3 Drawing Sheets

RESISTANCE ADJUSTABLE EXERCISE DEVICE

BACKGROUND

1. Field

The present general inventive concept relates generally to an exercise device, and particularly, to a resistance adjustable exercise device.

2. Description of the Related Art

Exercise is any type of bodily activity that enhances and/or maintains physical fitness. The types of exercise can range from cardiovascular activities to weight training. Moreover, engaging in any form of exercise provides not only improves health and physical wellness, but also stimulates production of endorphins, which translates to an improvement in mood and/or state of mind.

For people dedicated to weight training, the most common exercise devices used include free weights, such as dumbbells and/or barbells, as well as weight machines. Regardless of the exercise device used, the objectives remain the same, which is to develop strength and/or size of muscle.

Some common exercise devices use weights, elastic bands, springs, and/or body weight of a user to provide resistance. However, the body weight of the user is often not sufficient to provide a challenge and/or offer strength-building exercises to muscles. The weights, bands, and/or springs have dangers associated with them that can injure the user and/or nearby persons. For example, the weights may fall either on the user and/or a nearby person. Additionally, the elastic bands and/or the springs can snap and/or recoil uncontrollably that strikes the user and/or the nearby person.

Another consideration is setup time. The common exercise devices can prolong a time needed to complete an exercise routine and customizing is limited. In other words, after performing a first exercise routine, the user needs to switch the weights and/the common exercise devices to perform a second exercise routine.

Therefore, there is a need for a resistance adjustable exercise device that does not rely on the weights, the elastic bands, and/or the springs, and allows multiple forms of exercise to be performed, such that the user does not have to switch to a different exercise device.

SUMMARY

The present general inventive concept provides a resistance adjustable exercise device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a resistance adjustable exercise device, including a resistance assembly to provide resistance to movement, a handle assembly connected to at least a portion of the resistance assembly to move the resistance assembly in at least one of a first rotational direction and a second rotational direction, and a control unit disposed on at least a portion of the handle assembly to adjust at least one of a first resistance level and a second resistance level of the resistance assembly.

The resistance assembly may include a main body, a first resistance unit connected within at least a portion of the main body to provide the first resistance level, a second resistance unit connected within at least a portion of the main body to provide the second resistance level, and a handle connector connected to a center portion of the main body and the handle assembly to move the resistance assembly in response to movement of the handle assembly.

The resistance assembly may further include an axle rod connected within the first resistance unit, the second resistance unit, and the handle connector to facilitate movement of the handle connector.

The main body may include a first section, and a second section removably connected to at least a portion of the first section.

The first section may include a first connector receiving groove disposed on at least a portion of a first side of the first section to receive a first side of the handle connector therein, a first rod receiving aperture disposed on at least a portion of a center of a second side of the first section to receive the axle rod therein, and a first cable receiving aperture disposed on at least a portion of the first side of the first section.

The first connector receiving groove may be recessed with respect to an edge of the first side of the first section.

The second section may include a second connector receiving groove disposed on at least a portion of a first side of the second section to receive a second side of the handle connector therein opposite with respect to the first side of the handle connector, a second rod receiving aperture disposed on at least a portion of a center of a second side of the second section to receive the axle rod therein, and a second cable receiving aperture disposed on at least a portion of the first side of the second section.

The second connector receiving groove may be recessed with respect to an edge of the first side of the second section.

The first resistance unit may include a first resistance clamp, a first disc connected to the first resistance clamp to be at least partially contacted by the first resistance clamp, such that the first resistance clamp resists movement against the first disc based on the first resistance level, and a first one-way bearing connected to at least a portion of a first side of the first disc to prevent movement of the first disc in the first rotational direction, and allow movement of the first disc in the second rotational direction.

The first resistance unit may further include a first radial bearing connected to at least a portion of a second side of the first disc to facilitate movement of the handle connector in at least one of the first rotational direction and the second rotational direction.

The second resistance unit may include a second resistance clamp, a second disc connected to the second resistance clamp to be at least partially contacted by the second resistance clamp, such that the second resistance clamp resists movement against the second disc based on the second resistance level, and a second one-way bearing connected to at least a portion of a first side of the second disc to prevent movement of the second disc in the second rotational direction, and allow movement of the second disc in the first rotational direction.

The second resistance unit may further include a second radial bearing connected to at least a portion of a second side of the second disc to facilitate movement of the handle connector in at least one of the first rotational direction and the second rotational direction.

The handle connector may include a handle receiving aperture disposed within at least a portion of a first end of the handle connector to receive the handle assembly therein, a first bearing receiving groove disposed on at least a portion of a first side of the handle connector, and a second bearing receiving groove disposed on at least a portion of a second side of the handle connector opposite with respect to the first side of the handle connector.

The first bearing receiving groove may be recessed with respect to an outer surface of the first side of the handle connector.

The second bearing receiving groove may be recessed with respect to an outer surface of the second side of the handle connector.

The resistance adjustable exercise device may further include a plurality of control cables disposed on at least a portion of the handle assembly to connect the resistance assembly to the control unit.

The resistance adjustable exercise device may further include a fixed housing connected to the resistance assembly to support the resistance assembly and the handle assembly thereon.

The resistance adjustable exercise device may further include a base connector connected to the fixed housing to connect the resistance assembly to the fixed housing.

The fixed housing may be a workout bench.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Figure 1:
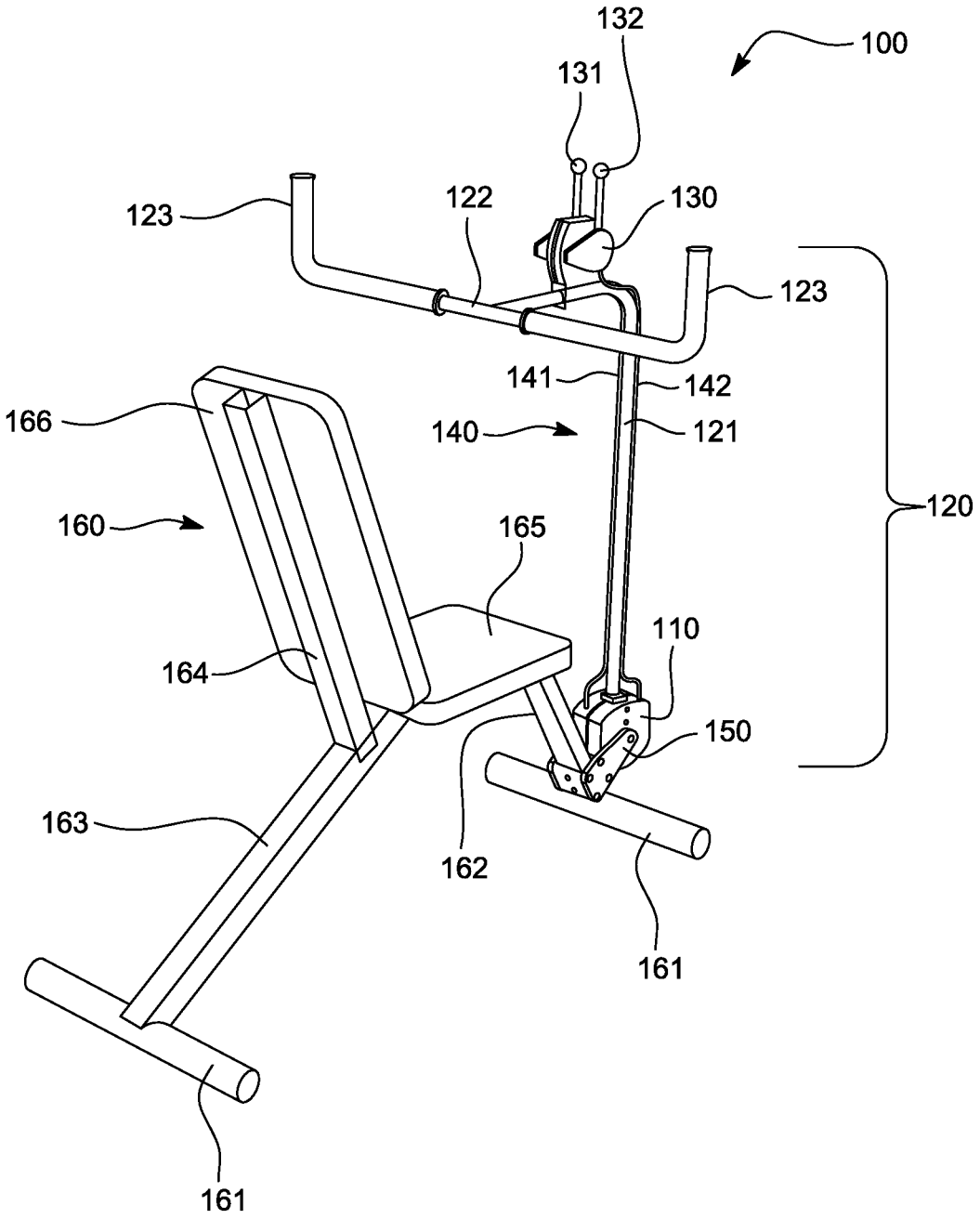
FIG. 1 illustrates a side perspective view of a resistance adjustable exercise device, according to an exemplary embodiment of the present general inventive concept.

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Resistance Adjustable Exercise Device 100
Resistance Assembly 110
Main Body 111
First Section 111*a*
First Connector Receiving Groove 111*a*1
First Rod Receiving Aperture 111*a*2
First Cable Receiving Aperture 111*a*3
Second Section 111*b*
Second Connector Receiving Groove 111*b*1
Second Rod Receiving Aperture 111*b*2
Second Cable Receiving Aperture 111*b*3
First Resistance Unit 112
First Resistance Clamp 112*a*
First Disc Receiving Groove 112*a*1
First Disc 112*b*
First One-Way Bearing 112*c*
First Radial Ball Bearing 112*d*
Second Resistance Unit 113
Second Resistance Clamp 113*a*
Second Disc Receiving Groove 113*a*1
Second Disc 113*b*
Second One-Way Bearing 113*c*
Second Radial Ball Bearing 113*d*
Handle Connector 114
Handle Receiving Aperture 114*a*
First Bearing Receiving Groove 114*b*
Second Bearing Receiving Groove 114*c*
Rod Receiving Aperture 114*d*
Axle Rod 115
Handle Assembly 120
Resistance Connecting Portion 121
Handle Bar 122
Friction Surfaces 123
Control Unit 130
First Lever 131

Second Lever 132
Control Cables 140
First Cable 141
Second Cable 142
Base Connector 150
Fixed Housing 160
Base 161
First Leg 162
Second Leg 163
Back Post 164
Seat 165
Backrest 166

FIG. 1 illustrates a side perspective view of a resistance adjustable exercise device 100, according to an exemplary embodiment of the present general inventive concept.

The resistance adjustable exercise device 100 may be constructed from at least one of metal, plastic, ceramic, wood, glass, and rubber, etc., but is not limited thereto.

The resistance adjustable exercise device 100 may include a resistance assembly 110, a handle assembly 120, a control unit 130, a plurality of control cables 140, a base connector 150, and a fixed housing 160, but is not limited thereto.

Figure 2A:
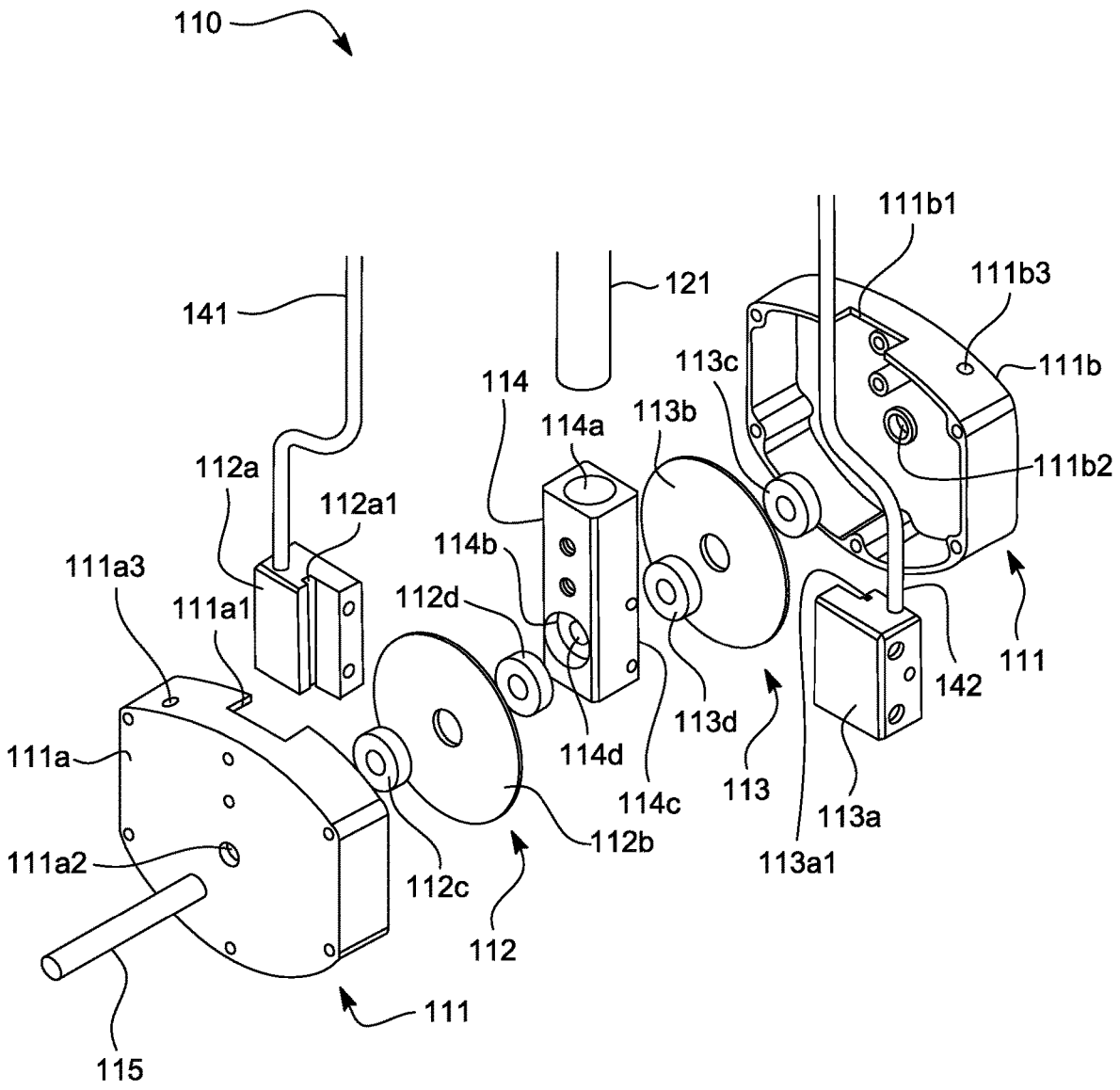
FIG. 2A illustrates an exploded view of a resistance assembly, according to an exemplary embodiment of the present general inventive concept.

FIG. 2A illustrates an exploded view of a resistance assembly 110, according to an exemplary embodiment of the present general inventive concept.

Figure 2B:
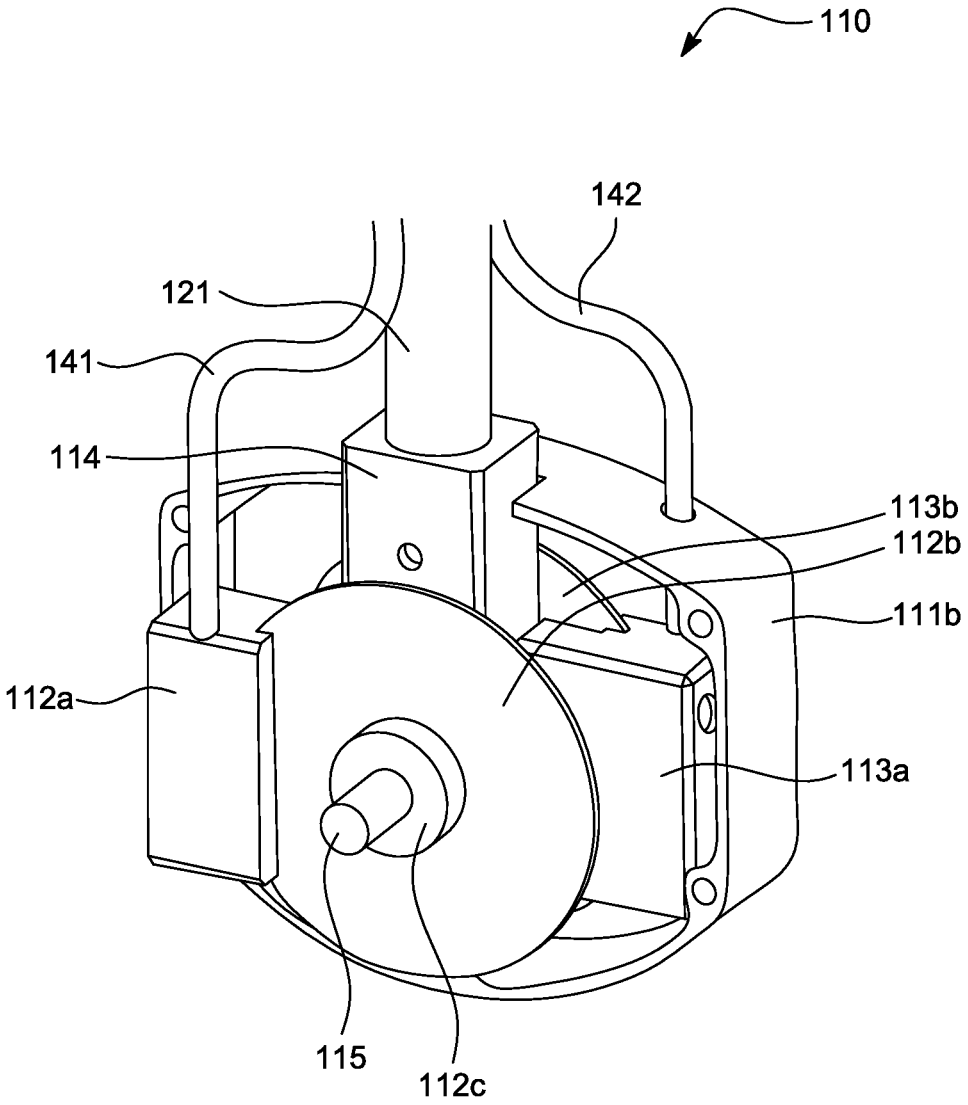
FIG. 2B illustrates a sectional view of the resistance assembly, according to an exemplary embodiment of the present general inventive concept.

FIG. 2B illustrates a sectional view of the resistance assembly 110, according to an exemplary embodiment of the present general inventive concept.

The resistance assembly 110 may include a main body 111, a first resistance unit 112, a second resistance unit 113, a handle connector 114, and an axle rod 115, but is not limited thereto.

The main body 111 may include a first section 111*a* and a second section 111*b*, but is not limited thereto.

The first section 111*a* may be removably connected to at least a portion of the second section 111*b*. In other words, the second section 111*b* may be removably connected to at least a portion of the first section 111*a*. Also, the first section 111*a* may have an equivalent size (e.g., length, width, height) as the second section 111*b*.

The first section 111*a* may include a first connector receiving groove 111*a*1, a first rod receiving aperture 111*a*2, and a first cable receiving aperture 111*a*3, but is not limited thereto.

The first connector receiving groove 111*a*1 may be disposed on at least a portion of a first side of the first section 111*a*. Moreover, the first connector receiving groove 111*a*1 may be recessed with respect to an edge of the first side of the first section 111*a*.

The first rod receiving aperture 111*a*2 may be disposed on at least a portion of a center of a second side of the first section 111*a*.

The first cable receiving aperture 111*a*3 may be disposed on at least a portion of the first side of the first section 111*a*.

The second section 111*b* may include a second connector receiving groove 111*b*1, a second rod receiving aperture 111*b*2, and a second cable receiving aperture 111*b*3, but is not limited thereto.

The second connector receiving groove 111*b*1 may be disposed on at least a portion of a first side of the second section 111*b*. Moreover, the second connector receiving groove 111*b*1 may be recessed with respect to an edge of the first side of the second section 111*b*.

The second rod receiving aperture 111*b*2 may be disposed on at least a portion of a center of a second side of the second section 111*b*.

The second cable receiving aperture 111*b*3 may be disposed on at least a portion of the first side of the second section 111*b*.

The first resistance unit 112 include a first resistance clamp 112*a*, a first disc 112*b*, a first one-way bearing 112*c*, and a first radial bearing 112*d*, but is not limited thereto.

Referring to FIGS. 2A and 2B, the first resistance unit 112 may be removably connected within at least a portion of the first section 111*a*.

The first resistance clamp 112*a* may be a disc brake, a brake caliper, a drum brake, and a ceramic brake, but is not limited thereto.

The first resistance clamp 112*a* may include a first disc receiving groove 112*a*1, but is not limited thereto.

The first disc receiving groove 112*a*1 may be disposed on at least a portion of the first resistance clamp 112*a*. Moreover, the first disc receiving groove 112*a*1 may receive at least a portion of the first disc 112*b* therein. Additionally, the first resistance clamp 112*a* may at least partially contact around the first disc 112*b* within the first disc receiving groove 112*a*1 to reduce movement (i.e. rotation) of the first resistance clamp 112*a* around the first disc 112*b*, such that the first resistance clamp 112*a* may provide a first resistance level against the first disc 112*b*.

Alternatively, the first resistance clamp 112*a* and/or the first disc 112*b* may be magnets having a repelling force, such that moving the first resistance clamp 112*a* closer to the first disc 112*b* increases the repelling force and/or resistance.

The first one-way bearing 112*c* may be connected (e.g., weld, keyway) to at least a portion of a first side of the first disc 112*b*. The first one-way bearing 112*c* may be connected to allow the first disc 112*b* to rotate in a first rotational direction (i.e. clockwise) or a second rotational direction (i.e. counterclockwise), such that the first disc 112*b* may rotate without restriction. However, the first one-way bearing 112*c* may prevent the first disc 112*b* from rotating in the second rotational direction or the first rotational direction. In other words, the first one-way bearing 112*c* may facilitate movement of the first disc 112*b* in a first direction (i.e. only one direction), and resists movement in a second direction opposite with respect to the first direction.

The first radial bearing 112*d* may be connected to at least a portion of a second side of the first disc 112*b*.

Furthermore, the first disc 112*b*, the first one-way bearing 112*c*, and/or the first radial bearing 112*d* may each have an aperture at a center thereof.

The second resistance unit 113 include a second resistance clamp 113*a*, a second disc 113*b*, a second one-way bearing 113*c*, and a second radial bearing 113*d*, but is not limited thereto.

Referring again to FIGS. 2A and 2B, the second resistance unit 113 may be removably connected within at least a portion of the second section 111*b*.

The second resistance clamp 113*a* may be a disc brake, a brake caliper, a drum brake, and a ceramic brake, but is not limited thereto.

The second resistance clamp 113*a* may include a second disc receiving groove 113*a*1, but is not limited thereto.

The second disc receiving groove 113*a*1 may be disposed on at least a portion of the second resistance clamp 113*a*. Moreover, the second disc receiving groove 113*a*1 may receive at least a portion of the second disc 113*b* therein. Additionally, the second resistance clamp 113*a* may at least partially contact around the second disc 113*b* within the second disc receiving groove 113*a*1 to reduce movement (i.e. rotation) of the second resistance clamp 113*a* around the second disc 113*b*, such that the second resistance clamp 113*a* may provide a second resistance level against the second disc 113*b*.

Alternatively, the second resistance clamp 113*a* and/or the second disc 113*b* may be magnets having a repelling force, such that moving the second resistance clamp 113*a* closer to the second disc 113*b* increases the repelling force and/or resistance The second one-way bearing 113*c* may be connected (e.g., weld, keyway) to at least a portion of a first side of the second disc 113*b*. The second one-way bearing 113*c* may be connected to allow the second disc 113*b* to rotate in the second rotational direction or the first rotational direction, such that the second disc 113*b* may rotate without restriction. However, the second one-way bearing 113*c* may prevent the second disc 113*b* from rotating in the first rotational direction or the second rotational direction. In other words, the second one-way bearing 113*c* may facilitate movement of the second disc 113*b* in the second direction (i.e. only one direction), and resists movement in the first direction opposite with respect to the second direction.

The second radial bearing 113*d* may be connected to at least a portion of a second side of the second disc 113*b*.

Furthermore, the second disc 113*b*, the second one-way bearing 113*c*, and/or the second radial bearing 113*d* may each have an aperture at a center thereof.

The handle connector 114 may be removably connected to a center portion of the main body 111 between the first section 111*a* and/or the second section 111*b*. Moreover, a first side of the handle connector 114 may be removably connected within at least a portion of the first connector receiving groove 111*a*1, and a second side of the handle connector 114 opposite with respect to the first side of the handle connector 114 may be removably connected within at least a portion of the second connector receiving groove 111*b*1. Accordingly, the main body 111 may move in response to movement of the handle connector 114.

The handle connector 114 may include a handle receiving aperture 114*a*, a first bearing receiving groove 114*b*, a second bearing receiving groove 114*c*, and a rod receiving aperture 114*d*, but is not limited thereto.

The handle receiving aperture 114*a* may be disposed within at least a portion of a first end of the handle connector 114. Additionally, a length of the handle receiving aperture 114*a* may extend at least a portion of a length of the handle connector 114.

The first bearing receiving groove 114*b* may be disposed on at least a portion of the first side of the handle connector 114. Also, the first bearing receiving groove 114*b* may be recessed with respect to an outer surface of the first side of the handle connector 114. The first bearing receiving groove 114*b* may receive the first radial bearing 112*d* therein.

The second bearing receiving groove 114*c* may be disposed on at least a portion of the second side of the handle connector 114. Also, the second bearing receiving groove 114*c* may be recessed with respect to an outer surface of the second side of the handle connector 114. The second bearing receiving groove 114*c* may receive the second radial bearing 113*d* therein.

The rod receiving aperture 114*d* may be disposed within at least a portion of a center of the first bearing receiving groove 114*b* and/or the second bearing receiving groove 114*c*. In other words, the rod receiving aperture 114*d* may extend between the first bearing receiving groove 114*b* and/or the second bearing receiving groove 114*c*.

The axle rod 115 may be removably connected within the first rod receiving aperture 111*a*2, the aperture of the first one-way bearing 112*c*, the aperture of the first disc 112*b*, the aperture of the first radial bearing 112*d*, the rod receiving aperture 114*d*, the aperture of the second radial bearing 113*d*, the aperture of the second disc 113*b*, the aperture of the second one-way bearing 113*c*, and/or the second rod receiving aperture 111*b*2. Moreover, the first radial bearing 112*d* and/or the second radial bearing 113*d* may facilitate movement (i.e. rotation) of the handle connector 114 in the first rotational direction or the second rotational direction about the axle rod 115.

The handle assembly 120 may include a resistance connecting portion 121, a handle bar 122, and a plurality of friction surfaces 123, but is not limited thereto.

Referring to FIG. 1, the resistance connecting portion 121 may be connected at a first end within at least a portion of the handle receiving aperture 114*a*. In other words, the handle receiving aperture 114*a* may receive the first end of the resistance connecting portion 121 therein. Additionally, the handle bar 122 may be disposed on at least a portion of a second end of the resistance connecting portion 121. Also, the resistance connecting portion 121 may bend and/or curve on at least a portion thereof, such that a first portion of the resistance connecting portion 121 is perpendicularly disposed and/or angularly disposed away from a second portion of the resistance connecting portion 121 with respect to a direction.

Each of the plurality of friction surfaces 123 may include a rubber surface, a gritted surface (e.g., sandpaper), and a knurled surface, but is not limited thereto.

A first of the plurality of friction surfaces 123 may be disposed on at least a portion of a first end of the handle bar 122 and a second of the plurality of friction surfaces 123 may be disposed on at least a portion of a second end of the handle bar 122. Accordingly, the handle bar 122 and/or the plurality of friction surfaces 123 may facilitate gripping thereof.

The control unit 130 may include a first lever 131 and a second lever 132, but is not limited thereto.

Referring to FIG. 1, the control unit 130 is illustrated to be disposed on at least a portion of the resistance connecting portion 121. However, the control unit 130 may be disposed on at least a portion of the handle bar 122, or any other feasible location as determined by one of ordinary skill in the art.

The first lever 131 and/or the second lever 132 may include a lever, a button, a dial, a switch, a knob, and/or any combination thereof, but is not limited thereto.

The plurality of control cables 140 may include a first cable 141 and a second cable 142, but is not limited thereto.

The first cable 141 may be connected at a first end to the first lever 131 and connected at a second end to the first resistance clamp 112*a*. Moreover, the first cable 141 may be disposed through the first cable receiving aperture 111*a*3. Finally, the first cable 141 may be disposed along at least a portion of a length of the resistance connecting portion 121.

Therefore, the first cable 141 may connect the first lever 131 to the first resistance clamp 112*a*. As such, the first resistance clamp 112*a* may at least partially contact around (i.e. move toward) the first disc 112*b* within the first disc receiving groove 112*a*1 in response to moving the first lever 131 in a first lateral direction, and at least partially move away from the first disc 112*b* in response to moving the first lever 131 in a second lateral direction.

The second cable 142 may be connected at a first end to the second lever 132 and connected at a second end to the second resistance clamp 113*a*. Moreover, the second cable 142 may be disposed through the second cable receiving aperture 111*b*3. Finally, the second cable 142 may be disposed along at least a portion of the length of the resistance connecting portion 121.

Therefore, the second cable 142 may connect the second lever 132 to the second resistance clamp 113*a*. As such, the second resistance clamp 113*a* may at least partially contact around (i.e. move toward) the second disc 113*b* within the second disc receiving groove 113*a*1 in response to moving the second lever 132 in the first lateral direction, and at least partially move away from the second disc 113*b* in response to moving the second lever 132 in the second lateral direction.

Referring again to FIG. 1, the base connector 150 may be connected to at least a portion of an outer surface of the first section 111*a* and/or at least a portion of an outer surface of the second section 111*b*, and connected to at least a portion of the fixed housing 160.

Referring again to FIG. 1, the fixed housing 160 is illustrated to be a workout bench. However, the fixed housing 160 may be a wall, a floor, a ground surface, a rigid platform, and/or any other combination thereof, but is not limited thereto.

The fixed housing 160 may include a base 161, a first leg 162, a second leg 163, a back post 164, a seat 165, and a backrest 166, but is not limited thereto.

The base 161 may be disposed on at least a portion of a surface, such as the ground surface. The base 161 may support the resistance assembly 110 and/or the handle assembly 120 thereon.

The first leg 162 may be angularly disposed away from the base 161 with respect to a first angular direction. The second leg 163 may be angularly disposed away from the base 161 with respect to a second angular direction different from the first angular direction. However, the first leg 162 and/or the second leg 163 may be oriented toward a common point between each other.

The back post 164 may be angularly disposed away from a center portion of the second leg 163 with respect to a third angular direction different from the first angular direction and/or the second angular direction.

The seat 165 may be disposed on at least a portion of the first leg 162 and/or the second leg 163. The backrest 166 may be disposed on at least a portion of the back post 164. The seat 165 and/or the backrest 166 may be a cushion. As such, the seat 165 and/or the backrest 166 may receive a user thereon. Also, the back post 164 may support the backrest 166 thereon.

Furthermore, the backrest 166 may include a chest strap, but is not limited thereto.

The chest strap may be disposed on at least a portion of the backrest 166 to connect via a fastener to another portion of the chest strap and/or the backrest 166, such that the chest strap may wrap around a chest of the user. Accordingly, the chest strap may prevent movement of the user during use of the handle assembly 120. For example, the chest strap may secure a back of the user against the backrest 166 while moving the handle assembly 120 toward user and/or the fixed housing 160.

In operation, the resistance assembly 110 via the handle connector 114 may move (i.e. rotate) around the axle rod 115 in response to moving (i.e. using an application of force to push and/or pull) the handle assembly 120 away from the fixed housing 160 (e.g., a bench press motion). The first resistance clamp 112*a* may at least partially contact the first disc 112*b* within the first disc receiving groove 112*a*1 while the first disc 112*b* remains stationary. As such, at least one first muscle of the user may be exercised using the resistance assembly 110. However, as noted above, the first resistance clamp 112*a* may have no resistance in response to moving the handle assembly 120 toward the fixed housing 160 due to the first one-way bearing 112*c* allowing the first disc 112*b* to move in that direction.

Similarly, the resistance assembly 110 via the handle connector 114 may move (i.e. rotate) around the axle rod 115 in response to moving (i.e. using an application of force to push and/or pull) the handle assembly 120 toward the fixed housing 160 (e.g., a seated row motion). The second resistance clamp 113*a* may at least partially contact the second disc 113*b* within the second disc receiving groove 113*a*1 while the second disc remains stationary. As such, at least one second muscle of the user may be exercised using the resistance assembly 110. However, as noted above, the second resistance clamp 113*a* may have no resistance in response to moving the handle assembly 120 away from the fixed housing 160 due to the second one-way bearing 113*c* allowing the second disc 113*b* to move in that direction.

Accordingly, the control unit 130 may adjust the first resistance level of the first resistance clamp 112*a* and/or the second resistance level of the second resistance clamp 113*a* based on a preference of the user as to which type of exercise is desired during movement of the handle assembly 120 toward and/or away from the fixed housing 160. Moreover, the resistance level of the first resistance clamp 112*a* and/or the second resistance clamp 113*a* may be varied between a weight equivalent of zero pounds to at least one hundred fifty pounds.

Therefore, the resistance adjustable exercise device 100 may provide a new method of strength-building that enables the user become stronger, quicker, and increase reaction time.

The resistance adjustable exercise device 100 may facilitate alternating between opposing muscle groups, such as contractile motions. As noted above, the resistance adjustable exercise device 100 may allow the user to perform a bench press followed by engaging the shoulder extensors and scapular retractors. As such, each muscle group is exercised in rapid alternating succession. The resistance adjustable exercise device 100 may improve quickness of each muscle group by allowing the user to switch movements quickly.

Furthermore, by alternating between opposing muscle group and a lack of eccentric phase of motion, the resistance adjustable exercise device 100 may allow one muscle group to remain "off" while the opposing group is "on" to be strengthened. This method of movement control may prevent the user from being injured when a specific muscle group has not relaxed prior to engaging the opposing muscle group.

The resistance adjustable exercise device 100 may provide a full exercise routing for strength training without use of weights, elastic bands, and/or springs to provide tension and/or resistance.

The present general inventive concept may include a resistance adjustable exercise device 100, including a resistance assembly 110 to provide resistance to movement, a handle assembly 120 connected to at least a portion of the resistance assembly 110 to move the resistance assembly 110 in at least one of a first rotational direction and a second rotational direction, and a control unit 130 disposed on at least a portion of the handle assembly 120 to adjust at least one of a first resistance level and a second resistance level of the resistance assembly 110.

The resistance assembly 110 may include a main body 111, a first resistance unit 112 connected within at least a portion of the main body 111 to provide the first resistance level, a second resistance unit 113 connected within at least a portion of the main body 111 to provide the second resistance level, and a handle connector 114 connected to a center portion of the main body 111 and the handle assembly 120 to move the resistance assembly 110 in response to movement of the handle assembly 120.

The resistance assembly 110 may further include an axle rod 115 connected within the first resistance unit 112, the second resistance unit 113, and the handle connector 114 to facilitate movement of the handle connector 114.

The main body 111 may include a first section 111*a*, and a second section 111*b* removably connected to at least a portion of the first section 111*a*.

The first section 111*a* may include a first connector receiving groove 111*a*1 disposed on at least a portion of a first side of the first section 111*a* to receive a first side of the handle connector 114 therein, a first rod receiving aperture 111*a*2 disposed on at least a portion of a center of a second side of the first section to receive the axle rod 115 therein, and a first cable receiving aperture 111*a*3 disposed on at least a portion of the first side of the first section 111*a*.

The first connector receiving groove 111*a*1 may be recessed with respect to an edge of the first side of the first section 111*a*.

The second section 111*b* may include a second connector receiving groove 111*b*1 disposed on at least a portion of a first side of the second section 111*b* to receive a second side of the handle connector 114 therein opposite with respect to the first side of the handle connector 114, a second rod receiving aperture 111*b*2 disposed on at least a portion of a center of a second side of the second section 111*b* to receive the axle rod 115 therein, and a second cable receiving aperture 111*b*3 disposed on at least a portion of the first side of the second section 111*b*.

The second connector receiving groove 111*b*1 may be recessed with respect to an edge of the first side of the second section 111*b*.

The first resistance unit 112 may include a first resistance clamp 112*a*, a first disc 112*b* connected to the first resistance clamp 112*a* to be at least partially contacted by the first resistance clamp 112*a*, such that the first resistance clamp 112*a* resists movement against the first disc 112*b* based on the first resistance level, and a first one-way bearing 112*c* connected to at least a portion of a first side of the first disc 112*b* to prevent movement of the first disc 112*b* in the first rotational direction, and allow movement of the first disc 112*b* in the second rotational direction.

The first resistance unit 112 may further include a first radial bearing 112*d* connected to at least a portion of a second side of the first disc 112*b* to facilitate movement of the handle connector 114 in at least one of the first rotational direction and the second rotational direction.

The second resistance unit 113 may include a second resistance clamp 113*a*, a second disc 113*b* connected to the second resistance clamp 113*a* to be at least partially contacted by the second resistance clamp 113*a*, such that the second resistance clamp 113*a* resists movement against the second disc 113*b* based on the second resistance level, and a second one-way bearing 113*c* connected to at least a portion of a first side of the second disc 113*b* to prevent movement of the second disc 113*b* in the second rotational direction, and allow movement of the second disc 113*b* in the first rotational direction.

The second resistance unit 113 may further include a second radial bearing 113*d* connected to at least a portion of a second side of the second disc 113*b* to facilitate movement of the handle connector 114 in at least one of the first rotational direction and the second rotational direction.

The handle connector 114 may include a handle receiving aperture 114*a* disposed within at least a portion of a first end of the handle connector 114 to receive the handle assembly 120 therein, a first bearing receiving groove 114*b* disposed on at least a portion of a first side of the handle connector 114, and a second bearing receiving groove 114*c* disposed on at least a portion of a second side of the handle connector 114 opposite with respect to the first side of the handle connector 114.

The first bearing receiving groove 114*b* may be recessed with respect to an outer surface of the first side of the handle connector 114.

The second bearing receiving groove 114*c* may be recessed with respect to an outer surface of the second side of the handle connector 114.

The resistance adjustable exercise device 100 may further include a plurality of control cables 140 disposed on at least a portion of the handle assembly 120 to connect the resistance assembly 110 to the control unit 130.

The resistance adjustable exercise device 100 may further include a fixed housing 160 connected to the resistance assembly 110 to support the resistance assembly 110 and the handle assembly 120 thereon.

The resistance adjustable exercise device 100 may further include a base connector 150 connected to the fixed housing 160 to connect the resistance assembly 110 to the fixed housing 160.

The fixed housing 160 may be a workout bench.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A resistance adjustable exercise device, comprising:

a resistance assembly to provide resistance to movement, the resistance assembly comprising:

a main body, a first resistance unit connected within at least a portion of the main body to provide the first resistance level, a second resistance unit connected within at least a portion of the main body to provide the second resistance level, and a handle connector connected to a center portion of the main body, the handle connector comprising:

a handle receiving aperture disposed within at least a portion of a first end of the handle connector to receive the handle assembly therein, a first bearing receiving groove disposed on at least a portion of a first side of the handle connector, and a second bearing receiving groove disposed on at least a portion of a second side of the handle connector opposite with respect to the first side of the handle connector;

a handle assembly connected to at least a portion of the resistance assembly to move the resistance assembly in at least one of a first rotational direction and a second rotational direction, such that the handle connector moves the resistance assembly in response to movement of the handle assembly; and a control unit disposed on at least a portion of the handle assembly to adjust at least one of a first resistance level and a second resistance level of the resistance assembly.

2. The resistance adjustable exercise device of claim 1, wherein the resistance assembly further comprises:

an axle rod connected within the first resistance unit, the second resistance unit, and the handle connector to facilitate movement of the handle connector.

3. The resistance adjustable exercise device of claim 2, wherein the main body comprises:

a first section; and a second section removably connected to at least a portion of the first section.

4. The resistance adjustable exercise device of claim 3, wherein the first section comprises:

a first connector receiving groove disposed on at least a portion of a first side of the first section to receive a first side of the handle connector therein;

a first rod receiving aperture disposed on at least a portion of a center of a second side of the first section to receive the axle rod therein; and a first cable receiving aperture disposed on at least a portion of the first side of the first section.

5. The resistance adjustable exercise device of claim 4, wherein the first connector receiving groove is recessed with respect to an edge of the first side of the first section.

6. The resistance adjustable exercise device of claim 4, wherein the second section comprises:

a second connector receiving groove disposed on at least a portion of a first side of the second section to receive a second side of the handle connector therein opposite with respect to the first side of the handle connector;

a second rod receiving aperture disposed on at least a portion of a center of a second side of the second section to receive the axle rod therein; and a second cable receiving aperture disposed on at least a portion of the first side of the second section.

7. The resistance adjustable exercise device of claim 6, wherein the second connector receiving groove is recessed with respect to an edge of the first side of the second section.

8. The resistance adjustable exercise device of claim 1, wherein the first resistance unit comprises:

a first resistance clamp;

a first disc connected to the first resistance clamp to be at least partially contacted by the first resistance clamp, such that the first resistance clamp resists movement against the first disc based on the first resistance level; and a first one-way bearing connected to at least a portion of a first side of the first disc to prevent movement of the first disc in the first rotational direction, and allow movement of the first disc in the second rotational direction.

9. The resistance adjustable exercise device of claim 8, wherein the first resistance unit further comprises:

a first radial bearing connected to at least a portion of a second side of the first disc to facilitate movement of the handle connector in at least one of the first rotational direction and the second rotational direction.

10. The resistance adjustable exercise device of claim 1, wherein the second resistance unit comprises:

a second resistance clamp;

a second disc connected to the second resistance clamp to be at least partially contacted by the second resistance clamp, such that the second resistance clamp resists movement against the second disc based on the second resistance level; and a second one-way bearing connected to at least a portion of a first side of the second disc to prevent movement of the second disc in the second rotational direction, and allow movement of the second disc in the first rotational direction.

11. The resistance adjustable exercise device of claim 10, wherein the second resistance unit further comprises:

a second radial bearing connected to at least a portion of a second side of the second disc to facilitate movement of the handle connector in at least one of the first rotational direction and the second rotational direction.

12. The resistance adjustable exercise device of claim 1, wherein the first bearing receiving groove is recessed with respect to an outer surface of the first side of the handle connector.

13. The resistance adjustable exercise device of claim 1, wherein the second bearing receiving groove is recessed with respect to an outer surface of the second side of the handle connector.

14. The resistance adjustable exercise device of claim 1, further comprising:

a plurality of control cables disposed on at least a portion of the handle assembly to connect the resistance assembly to the control unit.

15. The resistance adjustable exercise device of claim 1, further comprising:

a fixed housing connected to the resistance assembly to support the resistance assembly and the handle assembly thereon.

16. The resistance adjustable exercise device of claim 15, further comprising:

a base connector connected to the fixed housing to connect the resistance assembly to the fixed housing.

17. The resistance adjustable exercise device of claim 15, wherein the fixed housing is a workout bench.

* * * * *